US008490247B2

(12) United States Patent
Luo et al.

(10) Patent No.: US 8,490,247 B2
(45) **Date of Patent: *Jul. 23, 2013**

(54) BUTTON ACTIVATED SPRING-LOADED HINGE ASSEMBLY

(75) Inventors: Yi-De Luo, Shenzhen (CN); Chao Duan, Shenzhen (CN); Chia-Hua Chen, Shindian (TW)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 205 days.

This patent is subject to a terminal disclaimer.

(21) Appl. No.: 13/098,115

(22) Filed: Apr. 29, 2011

(65) Prior Publication Data

US 2012/0149445 A1 Jun. 14, 2012

(51) Int. Cl.
*E05D 11/10* (2006.01)

(52) U.S. Cl.
USPC ..... 16/326; 16/303; 455/575.3; 361/679.27; 379/433.13

(58) Field of Classification Search
USPC ..... 16/324–326, 327–329, 297, 303, 16/330, 334, 331, 332; 455/575.3; 361/679.27; 379/433.13
See application file for complete search history.

(56) References Cited

U.S. PATENT DOCUMENTS

| | | | | |
|---|---|---|---|---|
| 7,237,304 | B2 * | 7/2007 | Duan et al. | 16/324 |
| 7,434,296 | B2 * | 10/2008 | Kubota | 16/330 |
| 7,594,638 | B2 * | 9/2009 | Chan et al. | 248/677 |
| 7,810,214 | B2 * | 10/2010 | Feng et al. | 16/348 |
| 7,814,619 | B2 * | 10/2010 | Kuwajima et al. | 16/303 |
| 7,818,845 | B2 * | 10/2010 | Hu et al. | 16/330 |
| 7,847,194 | B2 * | 12/2010 | Kuwajima et al. | 174/161 R |
| 7,895,710 | B2 * | 3/2011 | Takagi et al. | 16/330 |
| 7,913,358 | B2 * | 3/2011 | Guo et al. | 16/330 |
| 8,006,346 | B2 * | 8/2011 | Zhang et al. | 16/303 |
| 2011/0286160 | A1 * | 11/2011 | Duan et al. | 361/679.01 |
| 2012/0106039 | A1 * | 5/2012 | Duan et al. | 361/679.01 |
| 2012/0140387 | A1 * | 6/2012 | Luo et al. | 361/679.01 |

* cited by examiner

*Primary Examiner* — William L. Miller
(74) *Attorney, Agent, or Firm* — Altis Law Group, Inc.

(57) ABSTRACT

A hinge assembly includes a follower member, a rotary member, two swing rods, a resilient member and a main shaft. The follower member includes a cam surface. The rotary member includes a latching cam surface. The two swing rods engage with the rotary second member. Each swing rod includes a contact area engaging the cam surface, and each swing rod is rotated to allow the follower member to automatically rotate relative to the latching cam surface. The resilient member provides an elastic force for the follower member abutting against the rotary member. The main shaft, the follower member, the rotary member, the resilient member are placed around the main shaft.

15 Claims, 5 Drawing Sheets

BUTTON ACTIVATED SPRING-LOADED HINGE ASSEMBLY

CROSS-REFERENCE TO RELATED APPLICATION

This application is related to co-pending U.S. patent application Ser. No. 13/097,217, entitled "BUTTON ACTIVATED SPRING-LOADED HINGE ASSEMBLY", by Duan et al., which has the same assignee as the present application. The above-identified application is incorporated herein by reference.

BACKGROUND

1. Technical Field

The present disclosure relates to hinge assemblies and, particularly, to a spring-loaded hinge assembly for foldable devices such as portable telephones and portable computers that can be activated by button.

2. Description of Related Art

Some hinge assemblies are spring-loaded to assist in opening the foldable parts of mobile phones, which generally include a cover section and a body section. This kind of hinge assembly includes threaded engagement of its parts and is relatively complicated to manufacture. In addition, the threaded structure needs to be made of costly, high strength material.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the present hinge assembly. Moreover, in the drawings, like reference numerals designate corresponding parts throughout the several views.

DETAILED DESCRIPTION

Figure 1:
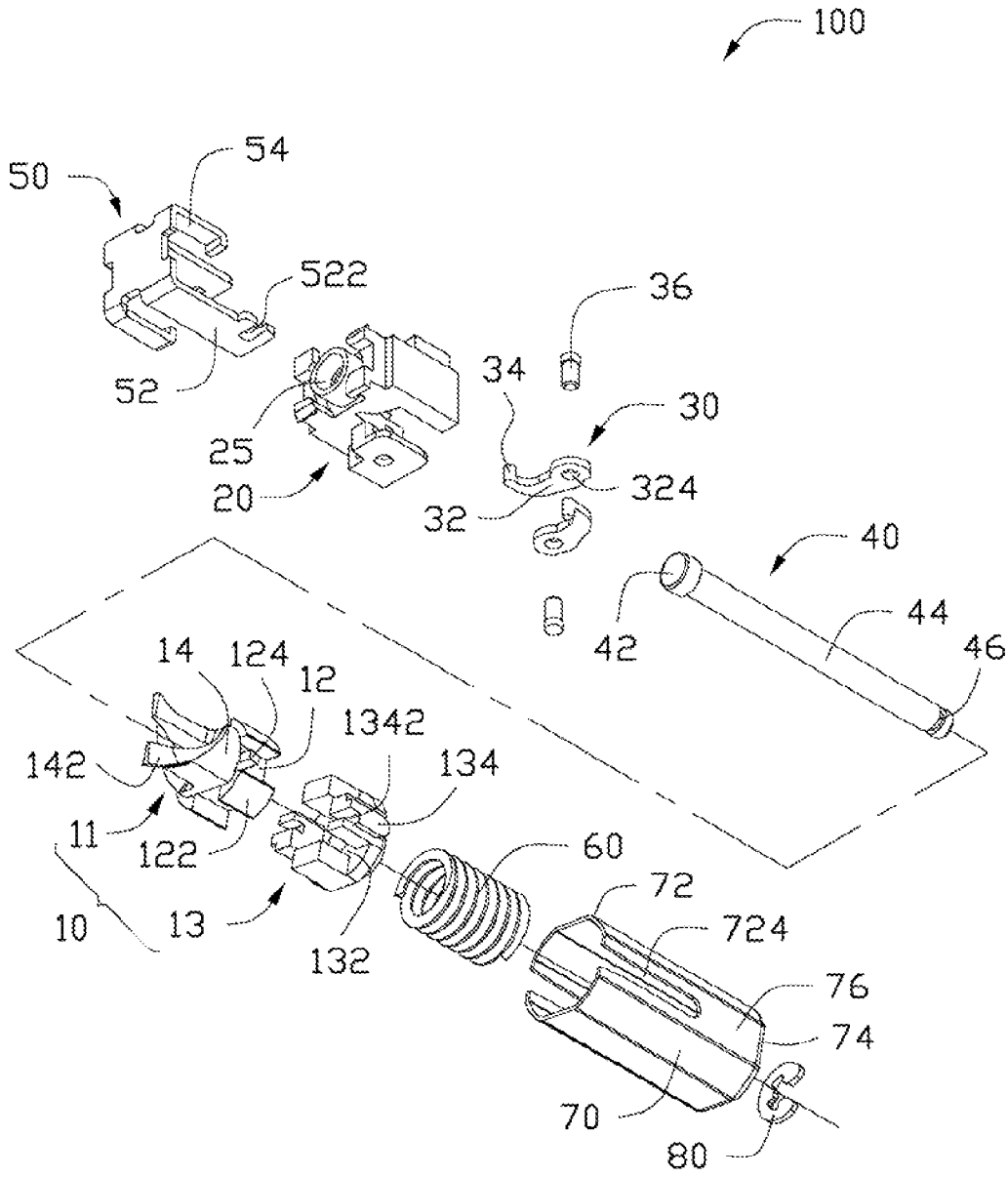
FIG. 1 is an exploded, isometric view of the exemplary embodiment of the hinge assembly shown in FIG. 1.
Figure 2:
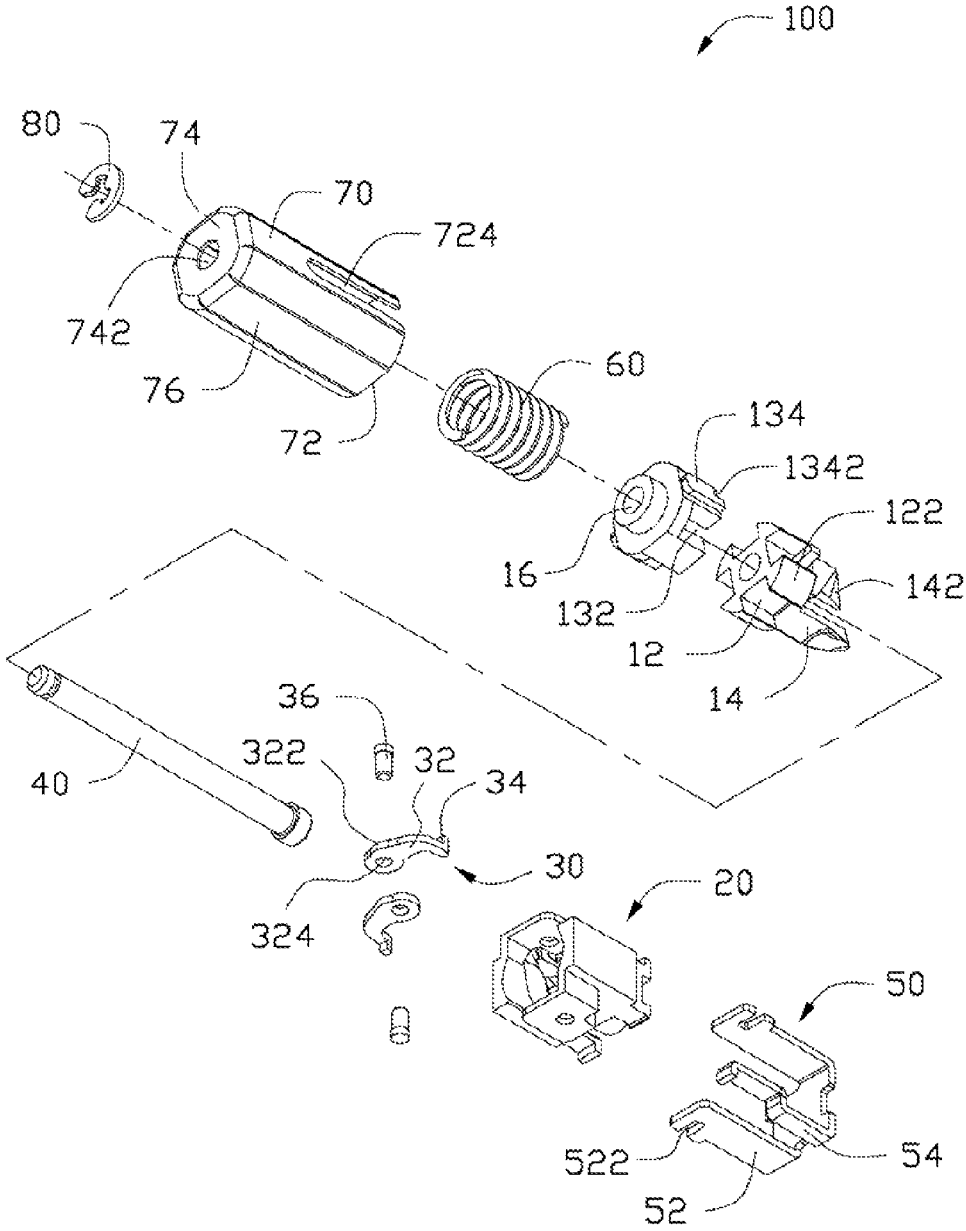
FIG. 2 is similar to FIG. 1, but viewed from another aspect.

Referring to the drawings in detail, FIGS. 1 and 2 show a hinge assembly 100 applied in a foldable electronic device such as a flip type mobile phone. The hinge assembly 100 can be used in other environments (e.g. cabinet doors). Although used here in a foldable electronic device, the hinge assembly 100 should not be considered limited in scope solely to foldable electronic devices.

The hinge assembly 100, in the embodiment illustrated, includes a follower member 10, a rotary member 20, two swing rods 30, two pivotal posts 36, a main shaft 40, a button member 50, a resilient member 60, a sleeve 70, and a washer 80.

The follower member 10 non-rotatably engages with the sleeve 70. In this exemplary embodiment, the follower member 10 includes a first element 11 and a second element 13 latched to each other. The first member 11 coaxially includes a head portion 12 and a cam portion 14 integrally formed together. In this exemplary embodiment, the head portion 12 includes two pairs of protrusions 122. A pin 124 is formed between each pair opposite protrusions 122. The cam portion 14 is formed at one side of the head portion 12, and has a smaller radius than the head portion 12. The cam portion 14 includes a cam surface 142 with peaks and valleys. The second member 13 defines four slots 132 and forms two projections 134. The protrusions 122 are latched in the slots 132. The projections 134 are for non-rotatably engaging with the sleeve 70. One end of each projection 134 toward the slots 132 defines a notch 1342 for receiving a corresponding pin 124. An axis hole 16 is defined in the first member 11 and the second member 13 to communicate the first member 11 and the second member 13.

Figure 3:
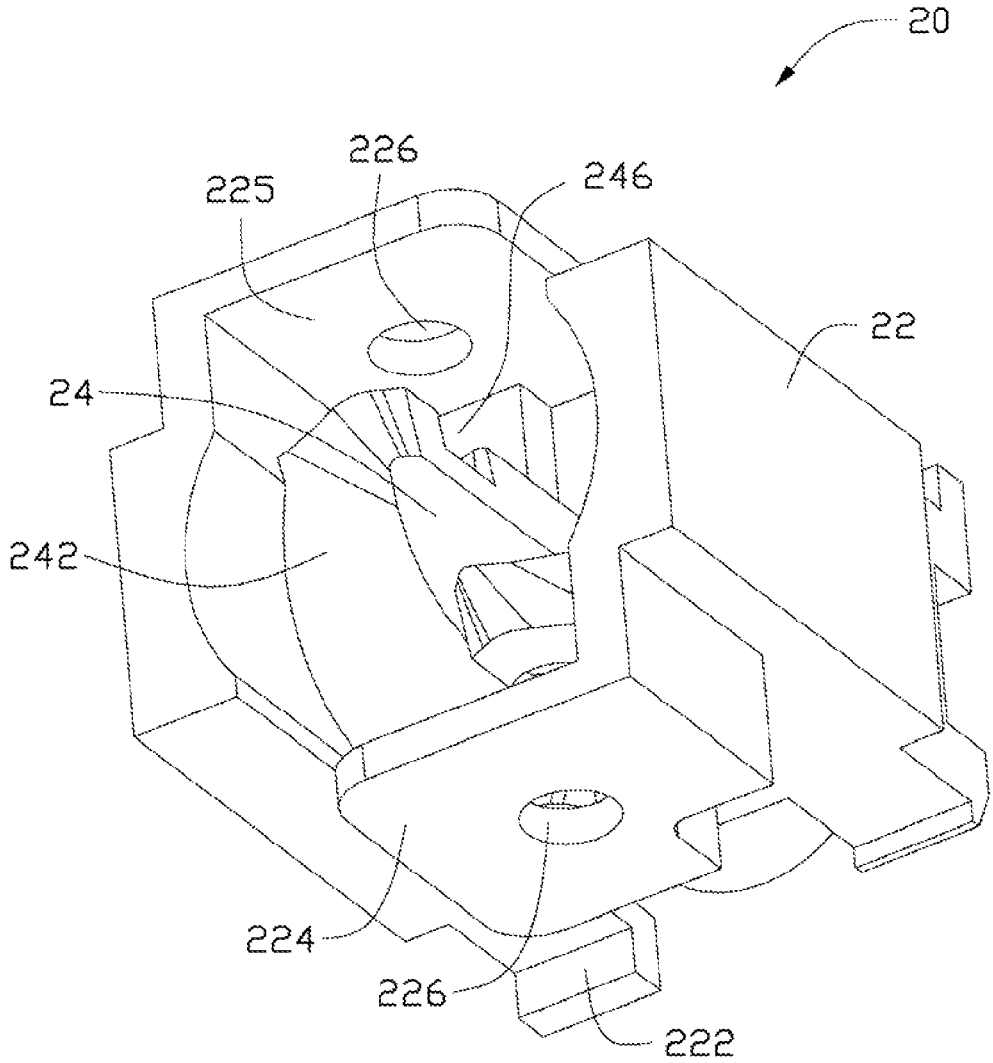
FIG. 3 is an enlarged view of the rotary member.

Referring to FIG. 3, the rotary member 20 includes a body portion 22. A plurality of hooks 222 (e.g. four hooks) are formed on one end of the body portion 22. Two cam portions 24 are formed at another end of the body portion 22. Each cam portion 24 forms a latching cam surface 242 for engaging with the cam surface 142. A hole 25 (FIG. 1) is defined in the body portion 22. Two L-shaped wing plates 224 are respectively formed at two sides of the body portion 22. A space 225 is defined between each wing plate 224 and each cam portion 24. Each wing plate 224 defines a pivotal hole 226, and each cam portion 24 defines a receiving groove 246. In this exemplary embodiment, the rotary member 20 is for engaging with a body section of the mobile phone.

Each swing rod 30 is rotatably received in the space 225. Each swing rod 30 includes a swing portion 32 and a rod portion 34 formed at one end of the swing portion 32. The swing portion 32 has a contact area 322. An outline of the contact area 322 is an involute curve. Since the normal line at any point of the contact area 322 is tangential to a base circle of the involute curve, the length of the lever arm used to calculate moment of force is equal to a radius of the base circle of the involute curve. When a predetermined moment of force is applied to the swing rods 30, the length of the lever arm is the same, and the forces applied in the contact area 322 remain constant throughout the rotation. Thus, the involute contact area 322 allows the swing rods 30 to stably and smoothly rotate. Each swing portion 32 defines a through hole 324. Each swing rod 30 is rotatably engaged in the rotary member 20 by the engagement between the pivotal post 36 and the through hole 324.

The main shaft 40 extends through, in order, the rotary member 20, the follower member 10, the resilient member 60, and the sleeve 70. The main shaft 40 includes a flange 42, a shaft portion 44, and a locking portion 46. The flange 42 is formed on one end of the main shaft 40, and the locking end 46 is formed on another opposite end thereof. The flange 44 prevents the elements on the main shaft 40 from separating from the end of the main shaft 40. The locking end 46 is for locking the washer 80.

The button member 50 is for pushing the swing rods 30 so that the swing rods 30 can rotate. In this exemplary embodiment, the button member 50 includes a pair of extending plates 52 interspersed by a pair of stopper plates 54. A distal end of each extending plate 52 defines a cutout 522 for receiving a corresponding rod portion 34. A distal end of each stopper plate 54 is substantially clasped with a corresponding hook 222. The hooks 222 of the rotary member 20 are used for preventing the stopper plates 54 from separating.

The resilient member 60 can be spiral-shaped (e.g. a coil spring). The resilient member 60 is fit around the main shaft 40, and exerts elastic force on the follower member 10 to push the follower member 10 toward the rotary member 20.

The sleeve 70 is substantially a hollow cylinder, and includes an open end 72 and a partially-closed end 74. The open end 72 defines two guiding grooves 724 for receiving the projections 134 to allow the first member 10 to be slidably received in the sleeve 70. The partially-closed end 74 of the sleeve 70 defines a central hole 742. Opposite portions of the sleeve 70 are shaped to form a plurality of planar surfaces 76 engaging with a cover section of the mobile phone.

The washer 80 is made of metal, and is engaged with the locking end 46 of the main shaft 40.

Figure 4:
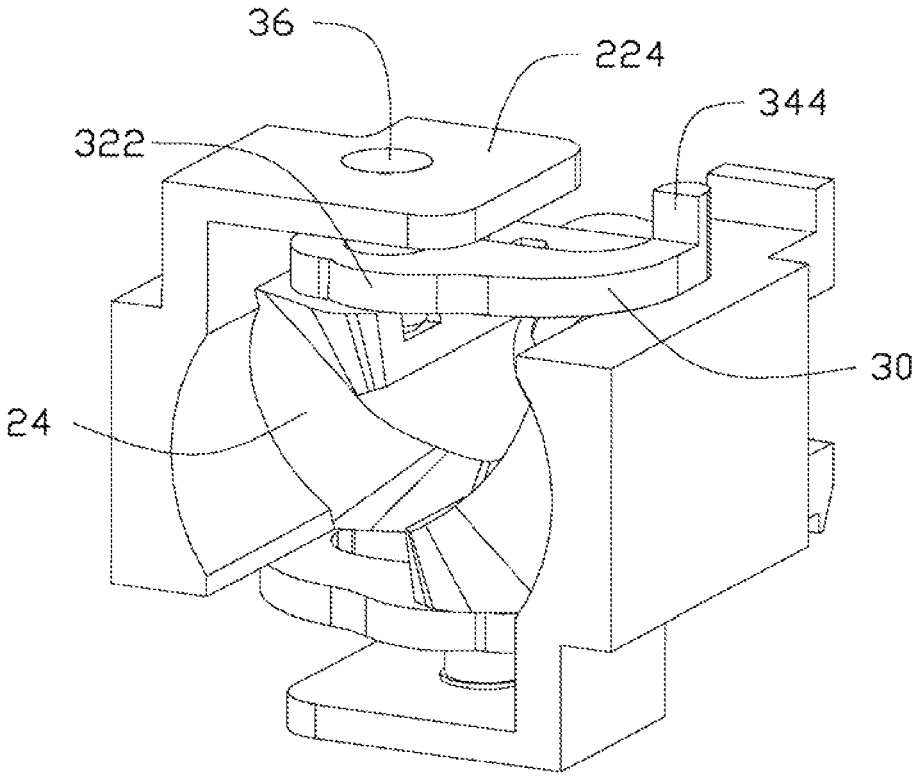
FIG. 4 is a schematic view showing two swing rods engaging in the rotary member.
Figure 5:
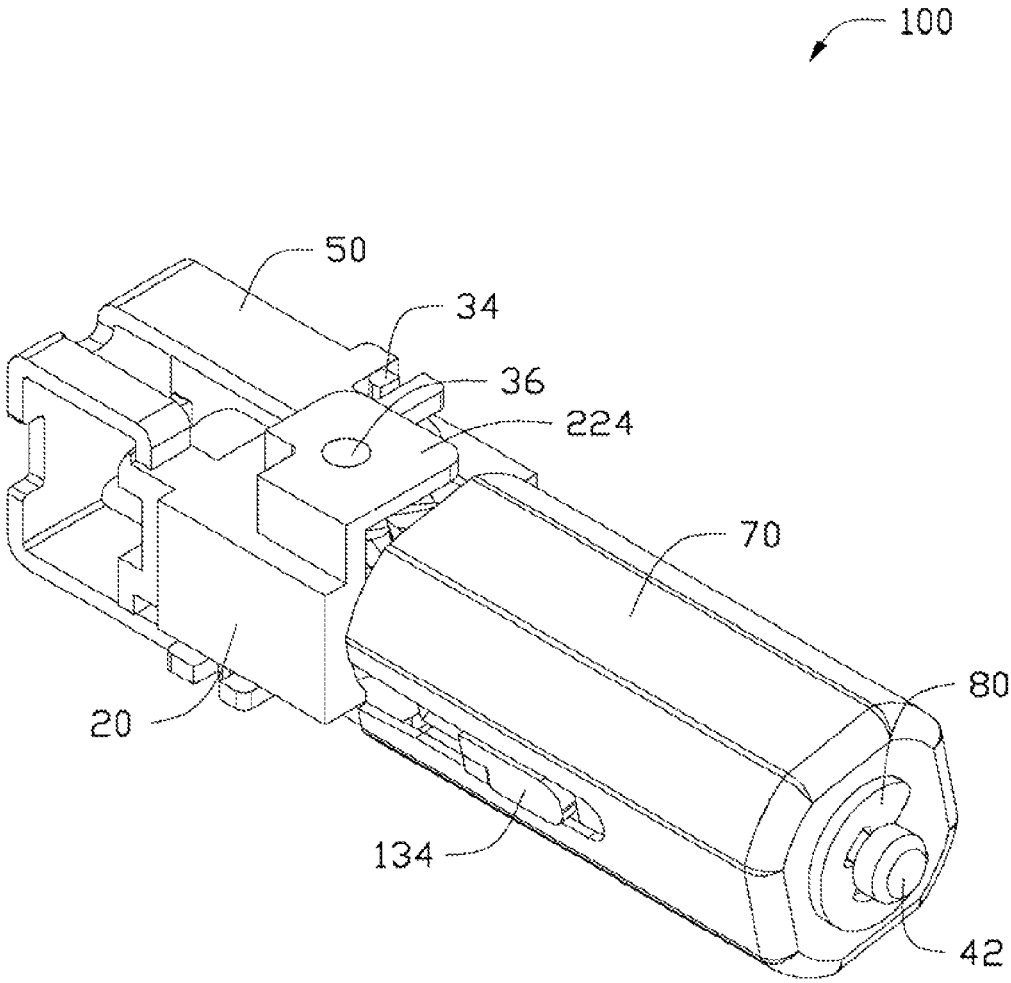
FIG. 5 is an assembled view showing the hinge assembly.

In assembly, referring to FIGS. 4 and 5, the swing rods 30 are rotatably assembled in the spaces 225 of the rotary members 20 by the pivotal posts 36. One end of the pivotal posts 36 are secured to the pivotal holes 226 of the wing plate 224, the other end of the pivotal posts 36 are secured to the receiving grooves 246. The first member 11 is latched to the second member 13 to constitute the follower member 10. Then, one end of the main shaft 40 extends through the rotary member 20. The follower member 10 is fit over the main shaft 40, with the cam surface 142 engaging with the latching cam surfaces 32. The resilient member 60 is fit over the main shaft 40 from the locking end 46. After the above elements are assembled, the sleeve 70 is placed around the main shaft 40. The projections 134 are received in the guiding grooves 724. The partially-closed end 74 of the sleeve 70 resists the resilient member 60, and the locking end 46 of the main shaft 40 extends through the hole 742. The washer 80 is latched on the locking end 46. Accordingly, the hinge assembly 100 is assembled.

When the cover section is closed relative to the body section, the swing rods 30 abut against positions of the cam surface 142 adjacent to peaks. To open the mobile phone, a user lightly presses the button member 50. When pressed, the button member 50 moves along an axial direction of the main shaft 40 to move the rod portions 34 of the rotary members 30. The swing portions 32 are forced to rotate over the peaks of the cam surface 142. Then, even after the button member 50 is released, the follower member 10 automatically further rotates relative to the second member 20. Furthermore, the follower member 10 rotates the sleeve 70 so that the cover section of the mobile phone is opened.

In this hinge assembly, users may apply a relatively smaller force on the button member to force the swing rods to rotate. The operation is easy, and this structure is simple.

It is believed that the present embodiments and their advantages will be understood from the foregoing description, and it will be apparent that different changes may be made thereto without departing from the spirit and scope of the disclosure or sacrificing all of its material advantages, the examples hereinbefore described merely being preferred or exemplary embodiments of the disclosure.

What is claimed is:

1. A hinge assembly, comprising:

a follower member including a cam surface;

a rotary member including a latching cam surface;

two swing rods rotatably engaging with the rotary member, each swing rod including a contact area engaging the cam surface, each swing rod being rotated to allow the follower member to automatically rotate relative to the latching cam surface;

a resilient member providing an elastic force for the follower member abutting against the rotary member; and a main shaft, wherein the follower member, the rotary member, and the resilient member are placed around the main shaft.

2. The hinge assembly as claimed in claim 1, further comprising two pivotal posts, each swing rod is rotatably engaged in the rotary member by the pivotal posts.

3. The hinge assembly as claimed in claim 1, wherein an outline of the contact area is an involute curve.

4. The hinge assembly as claimed in claim 1, further comprising a button member, the button member is for pushing the swing rods so that the swing rods can rotate.

5. The hinge assembly as claimed in claim 4, wherein the button member includes a pair of extending plates interspersed by a pair of stopper plates.

6. The hinge assembly as claimed in claim 5, wherein a distal end of each extending plate defines a cutout for receiving one part of each swing rod, the rotary member includes a plurality of hooks, a distal end of each stopper plate is clasped with the hooks.

7. The hinge assembly as claimed in claim 1, wherein each swing rod includes a swing portion and a rod portion formed at one end of the swing portion, the swing portion has the contact area.

8. A foldable electronic device having at least two components hinged together by a hinge assembly, the hinge assembly comprising:

a first member including a cam surface;

a second member;

two swing rods rotatably engaging with the second member, each swing rod including a contact area engaging the cam surface;

a resilient member providing an elastic force for the first member abutting against the second member; and a main shaft, wherein the first member, the second member, and the resilient member placed are around the main shaft;

wherein after the swing rods are rotated, the first member automatically rotates relative to the second member.

9. The foldable electronic device as claimed in claim 8, wherein an outline of the contact area is an involute curve.

10. The foldable electronic device as claimed in claim 9, further comprising two pivotal posts, each swing rod is rotatably engaged in the second member by the pivotal posts.

11. The foldable electronic device as claimed in claim 10, further comprising a button member, the button member is for pushing the swing rods so that the swing rods can rotate.

12. The foldable electronic device as claimed in claim 8, wherein the first member coaxially includes a head portion and a cam portion integrally formed together, the cam portion has the cam surface, the head portion includes two pairs of protrusions, and a pin is formed between each pair protrusions.

13. The foldable electronic device as claimed in claim 12, wherein the second member defines four slots and forms two projections, the protrusions are latched in the slots, one end of each projection toward the slots defines a notch receiving a corresponding pin.

14. The foldable electronic device as claimed in claim 8, wherein two L-shaped wing plates are respectively formed at two sides of the second member, a space is defined under each wing plate.

15. The foldable electronic device as claimed in claim 14, wherein each wing plate defines a pivotal hole for receiving one end of each swing rod.

* * * * *